US006186347B1

(12) United States Patent
Reifenscheid et al.

(10) Patent No.: US 6,186,347 B1
(45) **Date of Patent: *Feb. 13, 2001**

(54) MOBILE CRANE WITH A TELESCOPIC JIB

(75) Inventors: Christian Reifenscheid; Walter Stowasser, both of Zweibrücken (DE)

(73) Assignee: Mannesmann AG, Düsseldorf (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/348,810

(22) Filed: Jul. 7, 1999

(30) Foreign Application Priority Data

Jul. 7, 1998 (DE) ..... 198 31 431

(51) Int. Cl.[7] ..... B66C 23/42
(52) U.S. Cl. ..... 212/300; 212/231; 212/348
(58) Field of Search ..... 212/300, 292, 212/230, 231, 232, 299, 264, 348

(56) References Cited

U.S. PATENT DOCUMENTS 3,430,778 * 3/1969 Brown ..... 212/300
3,620,379 * 11/1971 Fauchere ..... 212/348
4,241,837 * 12/1980 Suverkrop ..... 212/177
4,569,454 * 2/1986 Sterner ..... 212/348
5,743,149 * 4/1998 Cullity ..... 212/348
5,769,251 * 6/1998 Wada et al. ..... 212/300

FOREIGN PATENT DOCUMENTS

2457240 * 12/1980 (FR) ..... 212/300

* cited by examiner

*Primary Examiner*—Thomas J. Brahan
(74) *Attorney, Agent, or Firm*—Cohen, Pontani, Lieberman & Pavane

(57) ABSTRACT

A mobile crane including an inclinable telescopic jib having a base case, a plurality of telescoping segments which can be extended and retracted, at least an inner-most one of the telescoping segments being pivotable in a direction of the inclinable jib and connected to a non-bending one of the segments by a hinge which forms a bending point which can be closed and opened, the hinge of the bending point being arranged on the underside of the jib, and an adjusting device arranged on a topside of the jib for opening and closing the bending point.

10 Claims, 8 Drawing Sheets

3)
2)
1)
13
14
15
16
17
18
19
20
21
22

4)

MOBILE CRANE WITH A TELESCOPIC JIB

BACKGROUND OF THE INVENTION

1. Field of the Invention

The invention relates to a mobile crane with a telescopic jib.

2. Discussion of the Prior Art

In order to increase the roller height, it is known for a lattice mast extension to be rigidly bolted on the head of the main jib of a mobile crane (in this regard, see extracts from the brochure Mannesmann Demag Fördertechnik, Demag AC 1600, pages 5, 17; Apr. 24, 1996). In order to enlarge the operating range of loads of equal weight which are to be hoisted, it is chosen to use a rockable auxiliary jib (see Demag AC 1600, pages 23, 24, 27, 28). A disadvantage here is that the auxiliary jib must additionally be transported and mounted on and dismounted from the main jib.

German reference DE 39 34 783 A1 discloses a crane which has an outrigger which, for its part, comprises a plurality of sections interconnected by joints. This crane is intended to be used as a multipurpose crane employed as a crane not only to hoist objects such as, for example, steel girders, but, at the same time, to support construction work. The essential elements of this crane are a basic frame, a drive part for driving and controlling the crane, which can be rotated on the basic frame in a horizontal plane, an articulated arm, attached to the drive part, which can be folded together and extended in a vertical plane, and a gripping device for gripping structural elements. The gripping device is connected to the front end of the arm in a fashion capable of tilting and being removed. A disadvantage of this design is that the jib length cannot be varied continuously in a direct fashion, but only by appropriately angling the individual links of the arm. Moreover, this design is not suitable for road transportation, since the articulated arm has to be partially dismounted. The articulation of the arm also limits the supported load which can be hoisted.

A generically determinative crane is disclosed in German reference DE 29 50 884 A1. This crane has a telescopic jib which comprises a base unit and a plurality of telescoping segments which can be extended and retracted by means of a telescopic device. The telescoping segments are connected to the base unit so that they can be pivoted in the direction of the jib. Arranged in the head region of the base unit is an angle insert whose inclination can be continuously adjusted via a piston-cylinder unit. The piston-cylinder unit is arranged on the underside of the jib, specifically such that the cylinder is pivoted at the underside of the base unit, and the piston rod is fastened to a comer point of the angle insert. The second corner point of the angle insert is connected to the telescoping segment situated after the bending point, while the hinge of the angle insert is arranged on the head of the base unit.

It is a disadvantage of this arrangement that it is thereby possible to bridge only very low troublesome edge heights, since this is essentially determined by the length of the base unit.

A slightly different design is shown by German reference DE B 19 65 118. In this known telescopic jib, there is arranged in the innermost telescoping segment a displaceable extension piece which, in its fully extended longitudinal position can be pivoted about the connecting element out of the position aligned with the longitudinal direction of the innermost telescoping segment, and can be fixed with respect thereto in predetermined pivot positions by means of a latch. The latch forms a stop in the aligned position of the extension piece. For the purpose of arranging the extension piece, a cutout is provided in the head part of the innermost telescoping segment and a plurality of recesses arranged on a circular arc around the connecting element are provided in the foot part of the extension piece. The latch engages in these recesses in the pivoted position of the extension piece.

The need to cut through the head part of the innermost telescoping segment is disadvantageous in this arrangement, with the result that the roller head configuration and the cable guidance are rendered difficult. A further disadvantage is that the longitudinal extent of the extension piece is limited, and the angling away can be done only in discrete angular degrees.

SUMMARY OF THE INVENTION

Accordingly, it is an object of the invention to provide a mobile crane of the generic type having a telescopic jib, with the aid of which it is possible to bridge a large troublesome edge height in a simple way in conjunction with an adequate horizontal extent.

Pursuant to this object, and others which will become apparent hereafter, one aspect of the present invention resides in a mobile crane in which at least the innermost telescoping segment can be pivoted and at least one non-bent telescoping segment is connected rearward thereto. The hinge of the bending point is arranged on the underside of the jib and the adjusting mechanism is arranged on the topside of the jib. With reference to the enclosed angle, the bend is preferably in a range from 90° to 180°. In order to render the possibility of use as wide as possible, two telescoping segments which can be mutually telescoped are preferably arranged both before and after the bending point. The adjusting mechanism can be of various types, for example a cable design, a gear rack, a spindle, two intermeshing gearwheels or a piston-cylinder unit. The last-named means has proved to be advantageous although it is expensive and has a relatively high weight.

For safety reasons, the bending point is secured in the closed position by means of a bolt fastened on a piston-cylinder unit. The bolt being arranged transverse to the longitudinal axis of the jib.

The advantage of the arrangement proposed is to be seen in that it is thereby possible to telescope essentially in the vertical direction and, superimposed thereon, essentially in the horizontal direction.

The bending point can be positioned at different points within the jib length, it having been found favorable when the jib length situated before the bending point is twice as long as the jib length situated after the bending point.

The mobile crane constructed according to the invention and with the telescopic jib is explained in more detail, with the aid of an exemplary embodiment, in the drawing.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
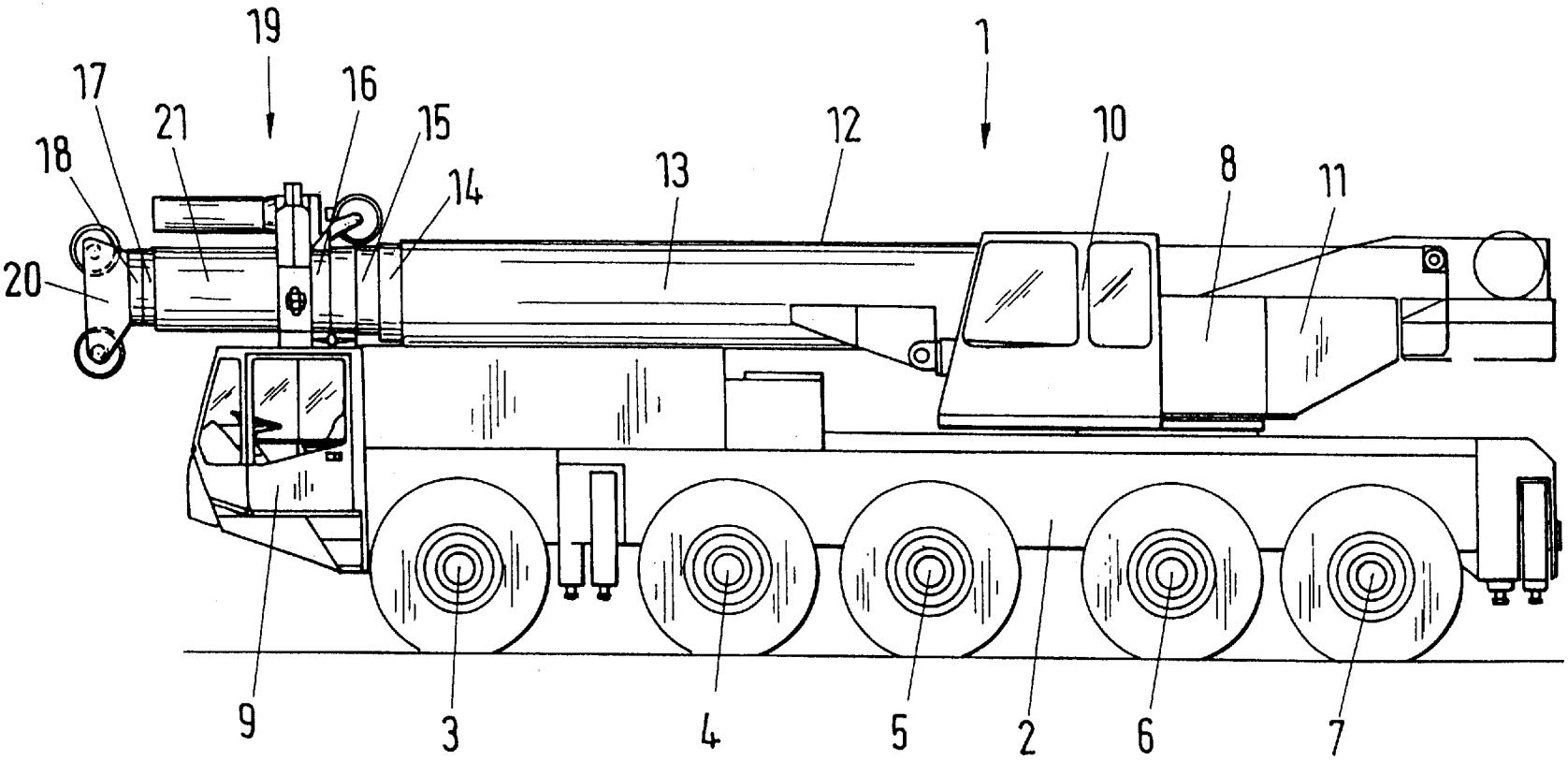
FIG. 1 shows a longitudinal view of a mobile crane, constructed according to the invention and with a telescopic jib.

A longitudinal view of a mobile crane 1, constructed according to the invention, with a telescopic jib is represented in FIG. 1. The main structural groups are an under carriage 2 with a total of five axles 3–7, and an upper carriage 8 arranged rotatably on the under carriage 2. Seen in the driving direction, a driver's cab 9 is arranged at the front end on the under carriage 2. Located on the upper carriage 8 are a crane cab 10 and a main jib 12 pivoted at a frame 11. This main jib 12 comprises a basic case 13 and five telescoping segments 14–18 which can be telescoped therein and of which three 14–16 are arranged before a bending point 19, and two 17, 18 are arranged after the bending point 19. A roller head 20 is arranged at the front end of the innermost telescoping segment 18. An adapter 21 for holding the two inner telescoping segments 17, 18 is provided directly at the bending point 19.

Figure 2:
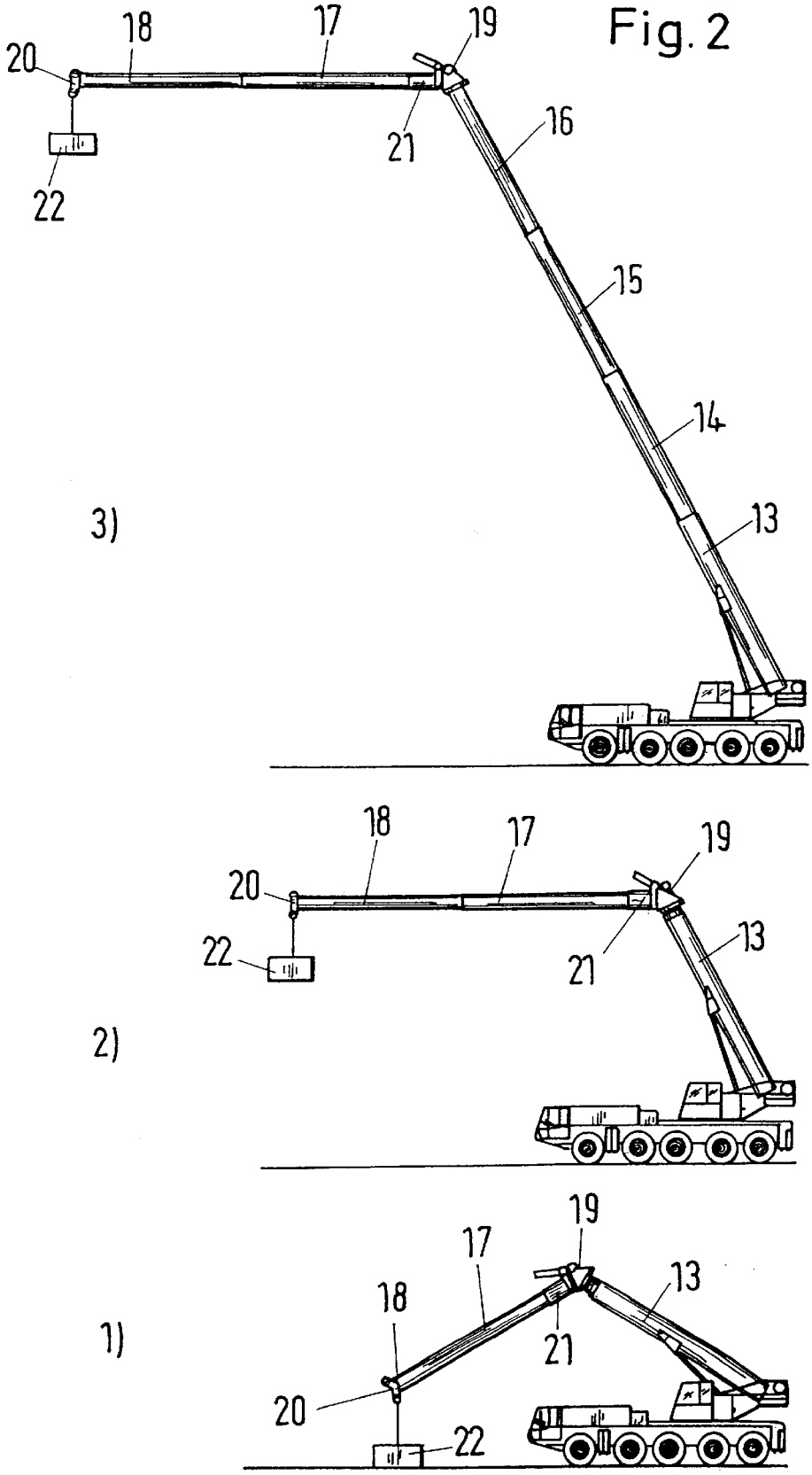
FIGS. 2, 3 show the essential possibilities of the jib system.
Figure 3:
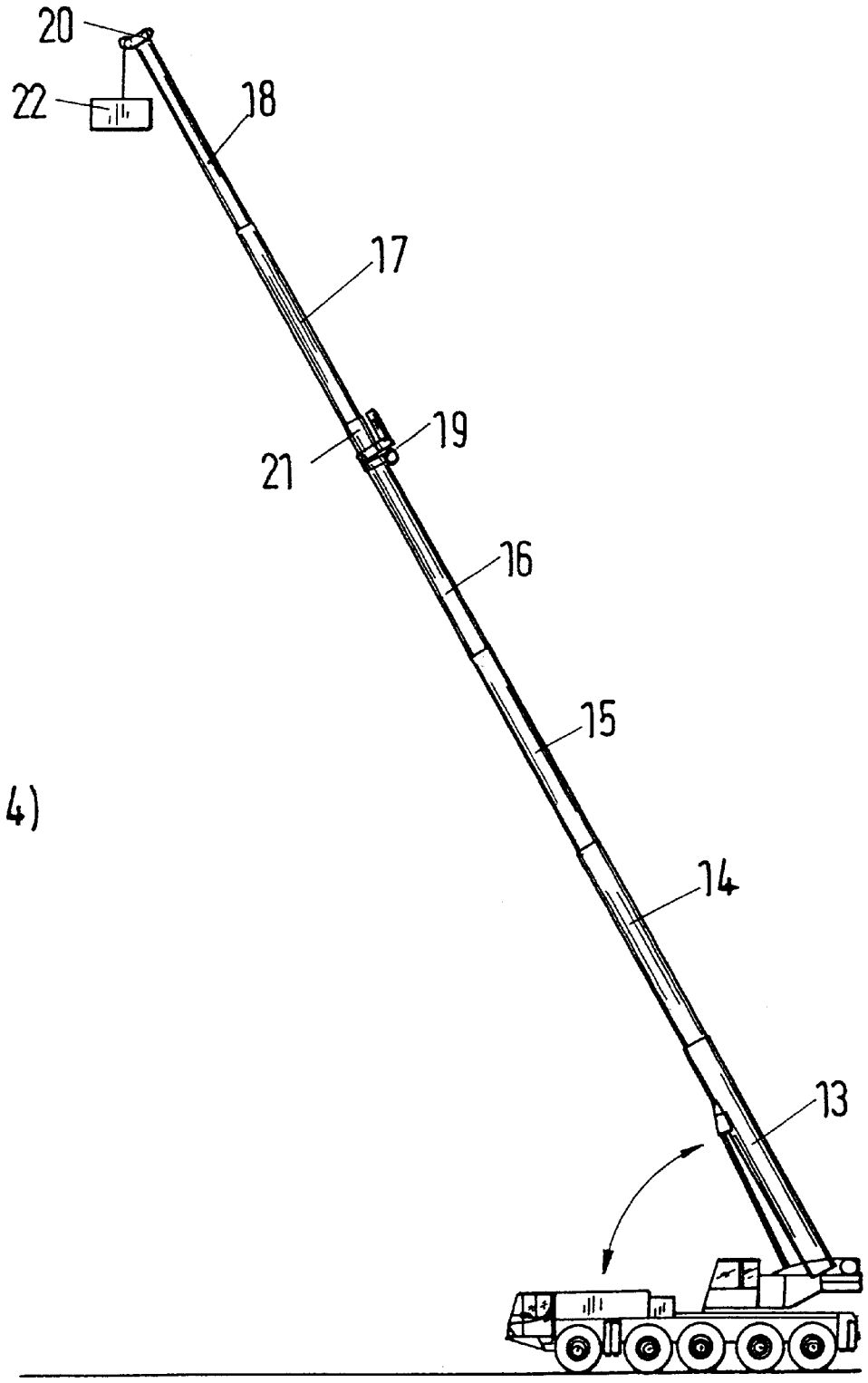

FIGS. 2 and 3 show the essential possibilities which can be realized with the jib system constructed according to the invention. Step 1 shows the telescoping outward of the telescoping segment 17 arranged directly after the bending point 19, with the telescoping segment 18 telescoped in, and the bending in order to be able to pick up a load 22. It is shown in step 2 that it is possible after raising the basic jib 13 for the telescoping segments 17, 18 arranged after the bending point 19 to be telescoped steplessly, into the horizontal here. It is shown in step 3 that the telescoping segments 14–16 can be telescoped steplessly before the bending point 19. The angle at the bending point 19 can be adapted steplessly independently thereof. The last step 4 shows the movement of the load 22 for a straight jib with the bending point 19 secured.

Figure 4:
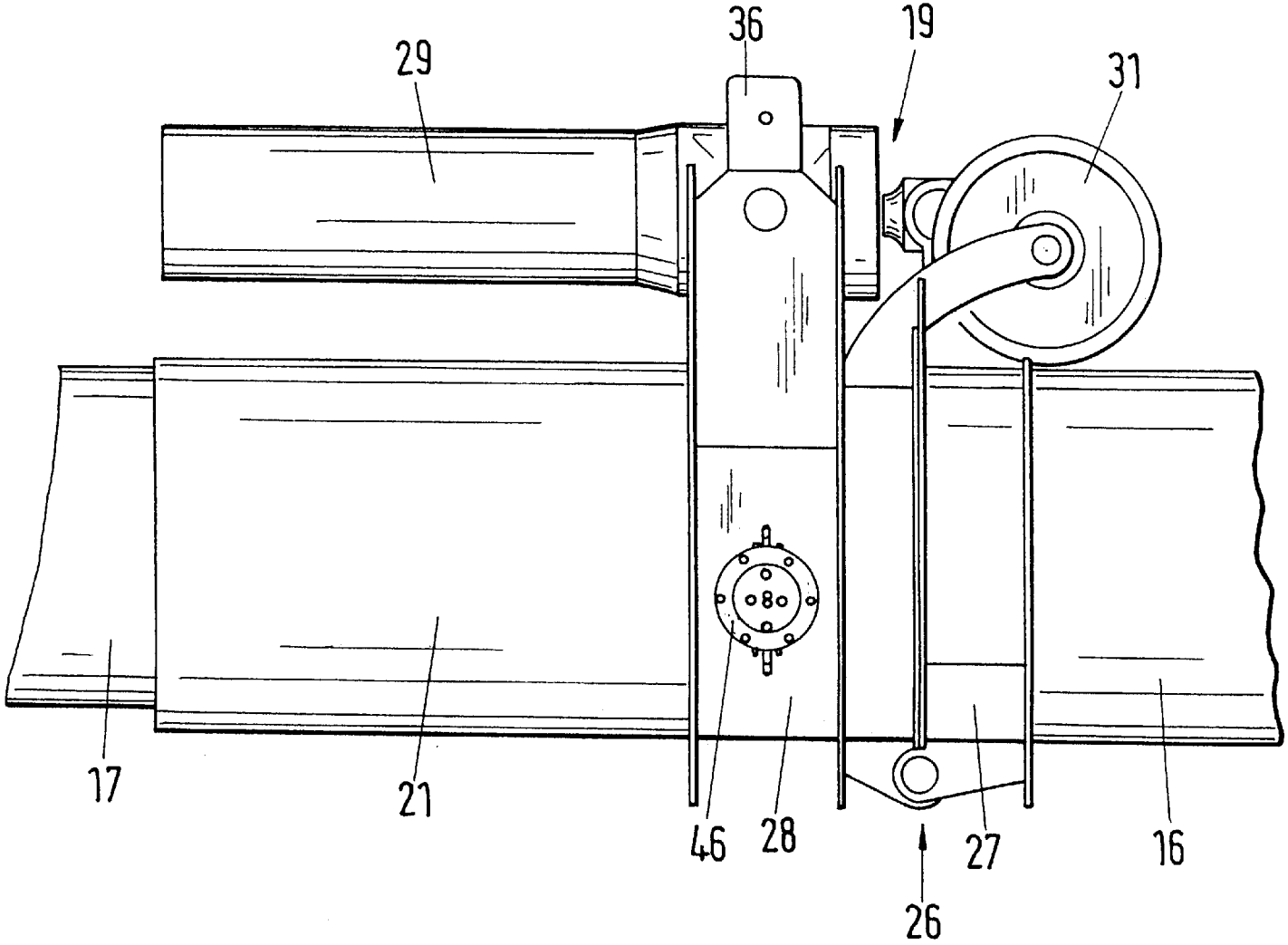
FIG. 4 shows an enlargement of the bending point.
Figure 5:
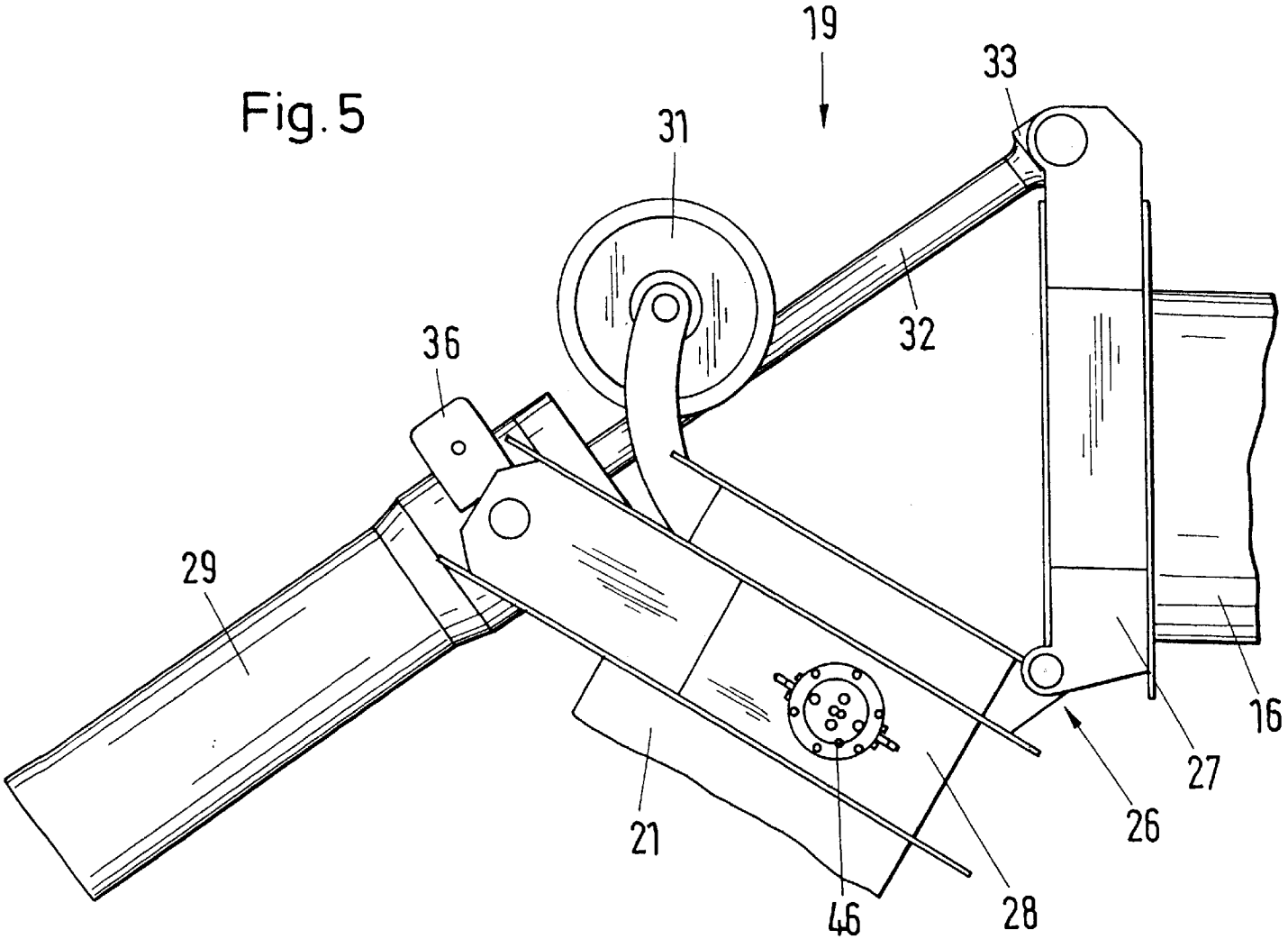
FIG. 5 shows as FIG. 4, but in the bent-away state.

Represented in FIGS. 4–8 are the details of the construction of the bending point 19, FIG. 4 showing the bending point 19 in the closed state, and FIG. 5 showing the bending point 19 in the open, that is to say in the bent state. In order to form a joint 26, the outer end region of the telescoping segment 16 situated before the bending point 19 has a collar-like frame part 27, and the adapter piece 21 situated after the bending point 19 likewise has a collar-like frame part 28. Fastened on the frame part 28 is, firstly, a piston-cylinder unit 29, and a cable pulley 31 guiding a load cable 30.

Figure 8:
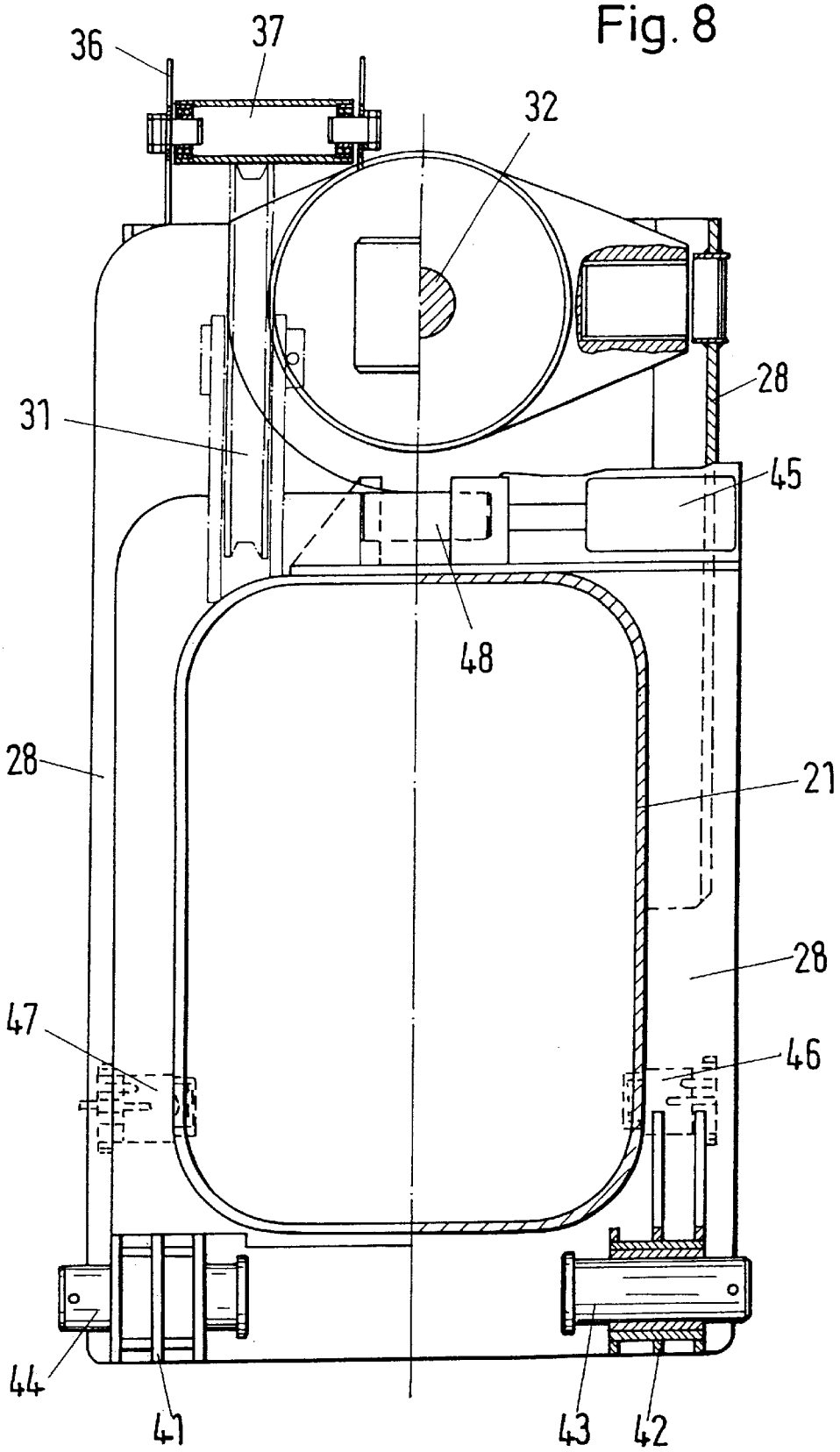
FIG. 8 shows a section VIII—VIII in FIG. 6.

In accordance with the representation in FIG. 8, two locking units 46, 47 situated opposite one another are arranged on the frame part 28 in order to be able to bolt the telescoping segment 17 situated after the bending point 19 to the frame part 28.

It emerges clearly from FIG. 5, i.e. in the bent state, that the piston rod 32 of the piston-cylinder unit 29 is arranged in a jointed fashion with an eye 33 on the head-side end of the frame part 27.

Figure 6:
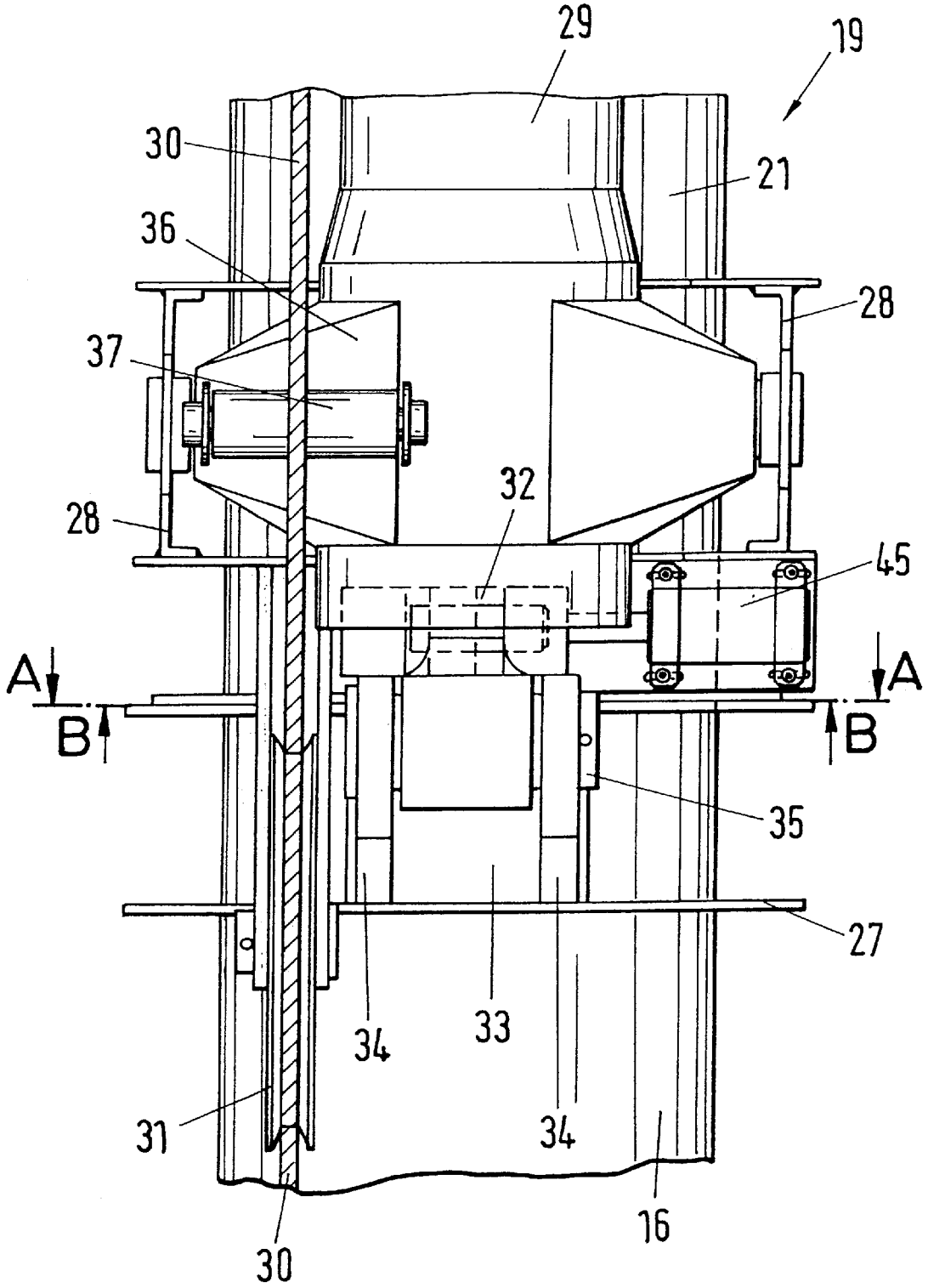
FIG. 6 shows a plan view of the bending point.
Figure 7:
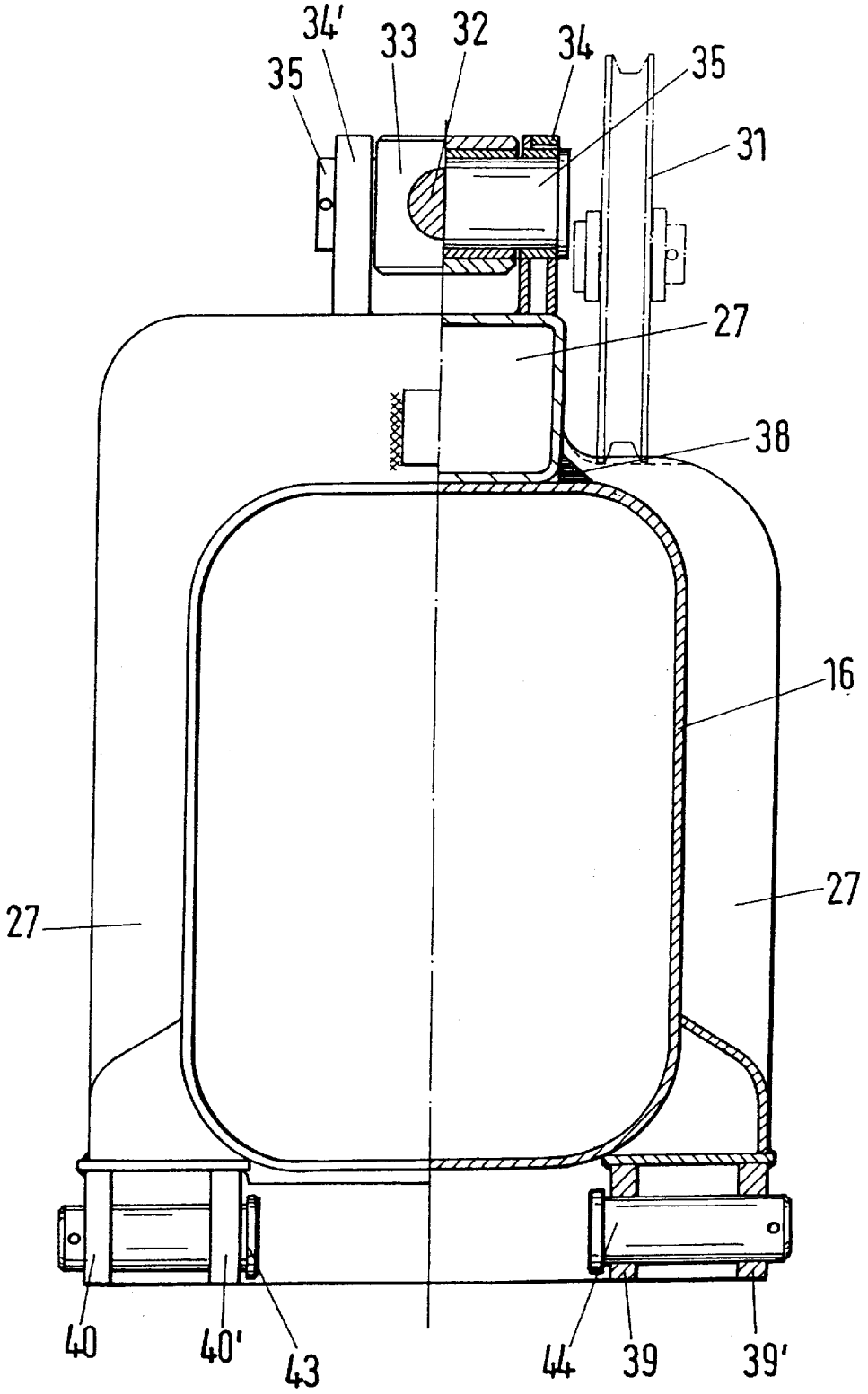
FIG. 7 shows a section VII—VII in FIG. 6.

FIG. 6 shows a plan view of the bending point 19, and FIGS. 7, 8 respectively show a section in FIG. 6. A bearing block 34, 34', through which a bolt 35 can be plugged, is provided on the frame part 27 in order to accommodate the eye 33 of the piston rod 32. So that the load cable 30 can be guided in the closed position (FIG. 4) without disturbance over the region of the piston-cylinder unit 29, an attachment 36 on which a roller 37 is rotatably arranged is fastened in the upper end region of the frame part 28. In order to secure the closed position of the bending point 19, there is arranged on the adapter 21 a piston-cylinder unit 45 on which a bolt 48 is fastened (FIG. 8). In the open position, the piston 29 is moved to the right together with the bolt 48, and the bending point 19 is released in this way.

It is to be seen in section VII—VII in accordance with FIG. 7 that the upper region of the frame part 27 is fastened to the telescoping segment 16 situated before the bending point 19 by means of a weld 38. Arranged in the lower region of the frame part 27 for the purpose of forming the joint 26 are two blocks 39, 39', 40, 40'. The blocks 39, 39', 40, 40' cooperate with webs 41, 42 of the frame part 28 and with bolts 43, 44 extend through the blocks 39, 39', 40, 40' and the webs 41, 42.

The invention is not limited by the embodiments described above which are presented as examples only but can be modified in various ways within the scope of protection defined by the appended patent claims.

We claim:

1. A mobile crane comprising an inclinable telescopic jib having:

a basic case;

a plurality of telescoping segments which can be extended from and retracted into the basic case, at least one of the telescoping segments being pivotable in a direction of the inclinable jib and connected to a non-bending one of the segments by a hinge which forms a bending point which can be closed and opened, the hinge of the bending point being arranged on a longitudinally extending underside of the jib, the pivotable telescoping segment being pivotable to 180° relative to the non-bending segment, all of the telescoping segments being retractable into the basic case; and adjusting means arranged on a longitudinally extending topside of the jib for opening and closing the bending point, the top side being opposite the bottom side, the adjusting means including a first piston-cylinder unit mounted on the top side of the jib for moving the hinge, and a securing element for securing the hinge in the closed position.

2. A mobile crane as defined in claim 1, wherein at least two of the telescoping segments which can be displaced into one another are arranged before and after the bending point, respectively.

3. A mobile crane as defined in claim 1, wherein the pivotable telescoping segment can be pivoted continuously from 180° to an enclosed angle of 90°.

4. A mobile crane as defined in claim 1, wherein the securing element is a second piston-cylinder unit with a bolt fastened thereto, the second piston-cylinder unit being arranged transverse to a longitudinal axis of the jib.

5. A mobile crane as defined in claim 1, and further comprising a separate telescopic device arranged in the telescoping segments after the bending point.

6. A mobile crane as defined in one of claim 1, and further comprising a box-shaped adapter arranged at the bending point so as to facilitate telescoping of the pivotable telescoping segment situated after the bending point, the adapter being connected by the hinge to a first of the telescoping segments situated before the bending point.

7. A mobile crane as defined in claim 6, and further comprising a first collar-like frame part arranged on the adapter, the first piston-cylinder unit being fastened to the first frame part, and a second collar-like frame part arranged on the first telescoping segment situated before the bending point, the first piston-cylinder unit having a piston rod pivoted at the second frame part.

8. A mobile crane as defined in claim 7, and further comprising a cable pulley arranged on the adapter for guiding a load cable.

9. A mobile crane as defined in claim 7, and further comprising locking means arranged on the frame part connected to the adapter for bolting the first frame part to the telescoping segment guided in the adapter.

10. A mobile crane as defined in claim 1, wherein in a fully extended state of the jib has a length before the bending point that is twice as long as a length situated after the bending point.

* * * * *